United States Patent [19]

Ueno

[11] Patent Number: 4,834,567

[45] Date of Patent: May 30, 1989

[54] CHARACTER-ERASABLE PRINTING APPARATUS

[75] Inventor: Hideo Ueno, Nagoya, Japan

[73] Assignee: Brother Kogyo Kabushiki Kaisha, Japan

[21] Appl. No.: 947,406

[22] Filed: Dec. 29, 1986

[30] Foreign Application Priority Data

Dec. 28, 1985 [JP] Japan ..... 60-297528
Mar. 19, 1986 [JP] Japan ..... 61-63206

[51] Int. Cl.[4] ..... B41J 29/26

[52] U.S. Cl. ..... 400/697.1; 400/233; 400/120

[58] Field of Search ..... 400/697.1, 697, 120, 400/233

[56] References Cited

U.S. PATENT DOCUMENTS 4,252,451 2/1981 Clancy et al. ..... 400/697.1
4,390,297 6/1983 Gantos et al. ..... 400/697.1
4,429,318 1/1984 Kobata ..... 400/697.1
4,445,693 10/1985 Bartlett et al. ..... 400/696
4,492,485 1/1985 Gall ..... 400/697.1
4,529,327 7/1985 Cremasco ..... 400/697.1
4,547,088 10/1985 Shattuck ..... 400/241.1
4,561,793 12/1985 Blanchard, Jr. ..... 400/697.1

FOREIGN PATENT DOCUMENTS 249762 11/1985 Japan ..... 400/697.1
249763 11/1985 Japan ..... 400/697.1

*Primary Examiner*—William Pieprz
*Attorney, Agent, or Firm*—Barnes & Thornburg

[57] ABSTRACT

The present invention is of a character-erasable printing apparatus adopting an erase controlling means which outputs to a printing mechanism a move control signal moving a printing head to the print position of the head character of a character string corresponding to the printing head and subsequently outputs to an erasing mechanism an erase control signal erasing characters sequentially from the head character to the last character on receiving an erase command from an inputting means.

6 Claims, 13 Drawing Sheets

CHARACTER-ERASABLE PRINTING APPARATUS

BACKGROUND OF THE INVENTION

The present invention relates to a printing apparatus, and specifically relates to a printing apparatus capable of automatically erasing a misprinted character string.

Conventionally, in printing apparatuses such as English character typewriters, a mechanism is provided which automatically erases a misprinted word using a correcting ribbon in the case where a misprint happens due to a wrong spelling. For example, as described in the Japanese Patent Laid-Open No. 210482/1985 (This application is claiming priority based on U.S. Pat. No. 4,561,793.), the conventional automatic word correcting apparatus for printing apparatus moves the correcting ribbon in a swing fashion to the print position when correcting the misprinted word, and erases the word from the last character to the head character in sequence. The purpose of such an erasure in the direction reverse to the printing direction is that a printing head is positioned at the position of the head character of the word when the erasure is completed, and thereby the correct word can be immediately re-printed.

The above-mentioned conventional automatic word correcting mechanism for printing apparatus is suitable for an application to the printing apparatus equipped with single printing type such as the daisy wheel.

By the way, in recent years, the thermal head has been applied widely to printing apparatuses such as the English character typewriters.

The applicant of the present patent has put the printing/correcting ribbon as described later into practical use by improving a physical structure of a thermo-transfer ribbon used for printing by the thermal head printing and erasing using a thermo-transfer ribbon and a thermal head is described in Japanese Patent Application No. 249762/1985 and the Japanese Patent Application No. 249763/1985.

At the thermal head, characters and the like are printed in combination of dot strings while the head is moved in the printing direction, and in this connection, the thermo-transfer ribbon is taken-up on a take-up spool from a feed spool only when the thermal head is moved in the printing direction.

Accordingly, when a misprinted word is erased sequentially from the last character to the head character by applying the conventional automatic word correcting apparatus to the thermal printer, such a control is to be repeated that each character is erased while the thermal head is moved in the printing direction, subsequently the thermal head is moved in the direction reverse to the printing direction to the position of character of higher-order side, and then the thermal head is moved again in the printing direction to erase the character. On the other hand, the ribbon can be fed also while moving the thermal head in the direction reverse to the printing direction, but this is complicated in mechanism.

Accordingly, the conventional automatic word correcting apparatus is difficult to be applied to the thermal printer.

SUMMARY OF THE INVENTION

The object of the present invention is that in the printing apparatus of thermal head type equipped with the thermo-transfer ribbon and the printing apparatus feeding the correcting ribbon by moving a carriage, in erasing a character string printed on a print paper; (1) erase control at automatic erasure of character string is simplified, (2) processing time is reduced, and (3) the character string is erased efficiently and economically.

As shown in a functional block diagram in FIG. 1, a character-erasable printing apparatus in accordance with the present invention is a printing apparatus having an inputting means for inputting data, a print data memory storing data inputted from the inputting means corresponding to the print position, a printing mechanism printing characters corresponding to the data inputted from the inputting means on a print paper, a present position memory storing the present position of a printing head of the printing mechanism corresponding to the print position, and an erasing mechanism erasing a character string printed by the printing mechanism in response to an erase command from the inputting means, wherein an erase controlling means are provided which compares the data of the print data memory with the data of the present position memory when receiving an erase command from the inputting means, outputs a move control signal moving the printing head to the print position of the head character of the character string corresponding to the printing head, and subsequently outputs to the erasing mechanism an erase control signal erasing characters in sequence from the head character to the last character.

Preferably, the above-mentioned erase controlling means comprises a controlling means moving the printing head to the position of the head character of the erased character string after erasure of the character string.

Preferably, the above-mentioned printing mechanism and the above-mentioned erasing mechanism have a thermo-transfer ribbon having printing and erasing functions, and the above-mentioned erase controlling means comprises a controlling means erasing the character string by printing the same characters on the printed characters in a superposed fashion.

Preferably, the above-mentioned erase controlling means comprises an erase suspend controlling means suspending erasing operation of the erasing mechanism by an erase suspend command signal from the inputting means.

Preferably, the above-mentioned erase suspend controlling means comprises a controlling means outputting a control signal which moves the printing head to the initial position before an input of the erasing command when the printing head is moving to the head character side of the character string and moves the printing head to the print position of the head character when the printing head is moving to the last character side while erasing characters.

Next, description is made on action of the above-mentioned printing apparatus.

Characters corresponding to the input data are printed on a print paper by the printing mechanism, while when an erase command is inputted from the inputting means, a predetermined length of character string is erased by the erasing mechanism. The present position of the printing head is stored in the present position memory corresponding to the print position, while the inputted data are stored in the print data memory corresponding to the print position. When a predetermined length of character string (character, word, printed line) printed on the print paper is erased, an erase command is inputted from the inputting means with the printing head positioned at the print position corresponding to any of characters of the character string to be erased or to the space next to the last character of the character string. Then, the erase controlling means outputs to the printing mechanism a move control signal moving the printing head to the print position of the head character of the above-mentioned character string based on the data of the print data memory and the data of the present position memory in response to the erase command, and thereby the printing head moves to the print position of the head character.

Subsequently, the erase controlling means receives data from the printing data memory and the present position memory, and outputs an erase control signal erasing the head character and the following characters of the character string in sequence to the erasing mechanism.

In short, when an erase command key is operated, the printing head moves to the corresponding print position of the head character of the character string, and the printed head character and the following characters are erased in sequence.

BRIEF DESCRIPTION OF THE DRAWINGS

FIG. 2 is a perspective view of an electronic typewriter, FIG. 3 is a plan view of a keyboard, FIG. 4 is a vertical cross-sectional view of a major part showing positional relationships among a thermal head, a platen and a paper feed roller, FIG. 5 is a horizontal sectional plan view of a ribbon feed mechanism in the printing state, FIG. 6 is a horizontal sectional plan view of the ribbon feed mechanism in the non-printing state, FIG. 7 is a cross-sectional view of a thermo-transfer ribbon, FIG. 8 and FIG. 9 are horizontal sectional views of a print paper and the thermo-transfer ribbon at printing and on completing printing respectively, FIG. 10 and FIG. 11 are horizontal sectional view of the print paper and the thermo-transfer ribbon at erasing characters and on completing erasure respectively, FIG. 12 is a block diagram of a controlling system of the typewriter, FIG. 13 is a view exemplifying relationships among the printed word, the print position and the data in an input data memory, FIG. 14 is a flowchart of a routine of character erase control associated with a first embodiment, and FIG. 15 is a flowchart of routines of character erase control and character erase suspend control associated with a second embodiment.

DETAILED DESCRIPTION OF THE INVENTION

Hereinafter, description is made on embodiments in accordance with the present invention based on FIG. 2 through FIG. 15.

Figure 1:
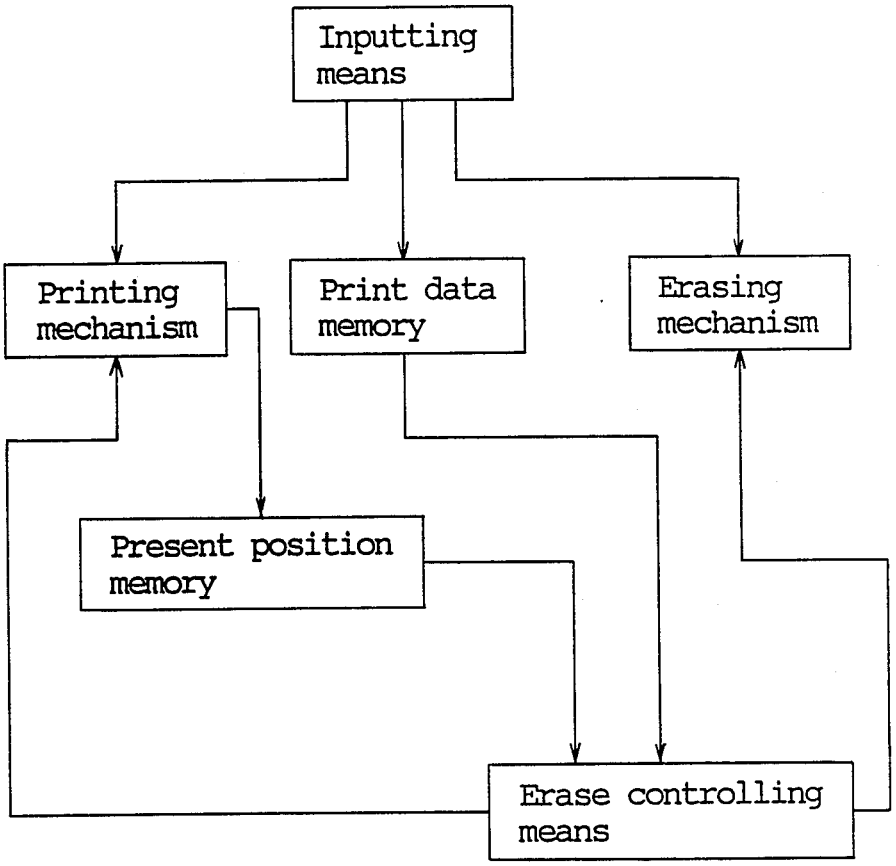
FIG. 1 is a functional block diagram showing a configuration in accordance with the present invention.
Figure 2:
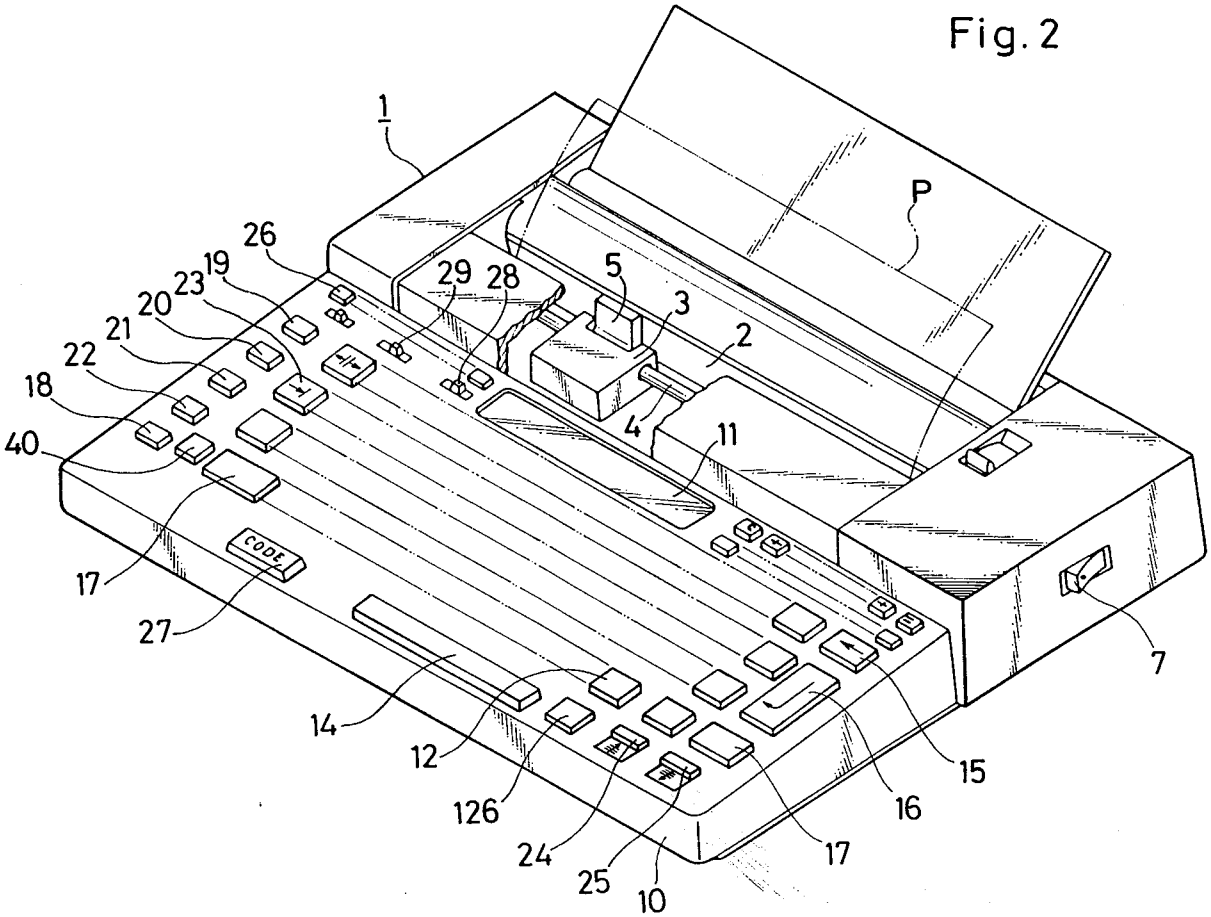
FIG. 2 through FIG. 15 show embodiments in accordance with the present invention.

As shown in FIG. 2, a platen 2 is supported at the rear side part of a main unit case 1 of a typewriter, and in front thereof a guide rod 4 extending in parallel with the platen 2 is disposed. A carriage 3 is supported on this guide rod 4 so as to be movable right and left along the platen 2. A thermal head 6 is attached to the carriage 3. Also, a keyboard 10 is installed at the front part of the main unit case 1, and a liquid crystal display (LCD) 11 is installed on the keyboard 10. Numeral 7 designates a power switch.

Figure 3:
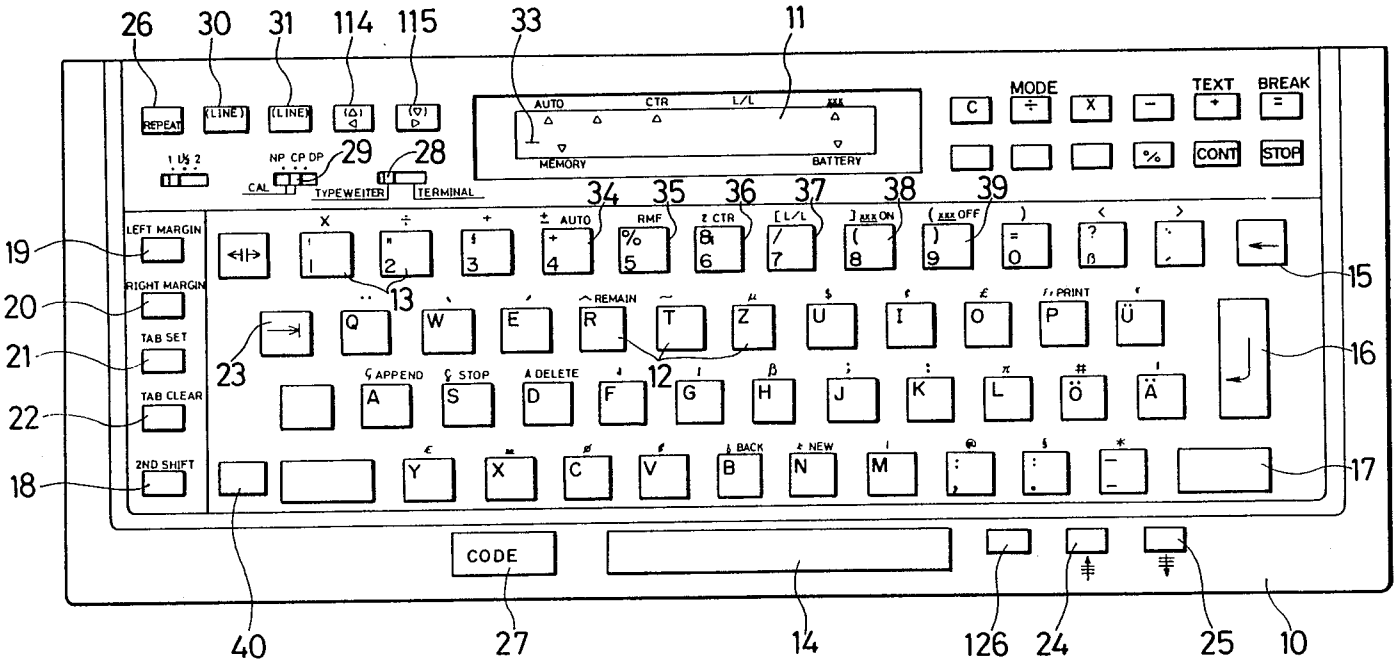

Furthermore, as shown in FIG. 3, the following operating members such as various keys and switches for operating the typewriter are disposed on the keyboard 10. Namely they are character and symbol keys comprising alphabetic keys 12, numeric keys 13 and a space key 14, a back space key 15, a carriage return key 16, a shift key 19, a right margin set key 20, a tab set key 21, a tab clear key 22, a tab key 23, a paper feed key 24, a paper return key 25, a repeat key 26, a code key 27, a first and a second mode select switches 28 and 29, an insert key 30, a delete key 31, cursor move keys 114 and 115, a word-out key 40 for outputting an erase command signal, a word-out suspend key 126 (erase suspend command key) for suspending erasing operation by the erase command signal and the like.

Among these keys and switches, the first mode select switch 28 is a two-position sliding switch for selecting either of two modes; a typewriter mode and a terminal mode. This typewriter mode is a mode wherein this typewriter is used as a normal typewriter, and the terminal mode is a mode wherein the typewriter is used as a data terminal apparatus. The second mode select switch 29 is three-position sliding switch for selecting any of three modes; a non-print mode, a correction print mode and a direct print mode. Here, the non-print mode is a mode wherein the key-input characters and the like are displayed on the liquid crystal display 11 without printing by the thermal head 5. The correction mode is a mode wherein the key-input characters and the like are displayed on the crystal display 11, and the data overflowing the display 11 are printed sequentially on a print paper P by the thermal head 5. The direct print mode is a mode wherein the key-input characters and the like are displayed on the crystal display 11 and at the same time they are printed on the print paper P by the thermal head 5. Here, description on the other keys is omitted because they are provided in normal typewriters.

Figure 4:
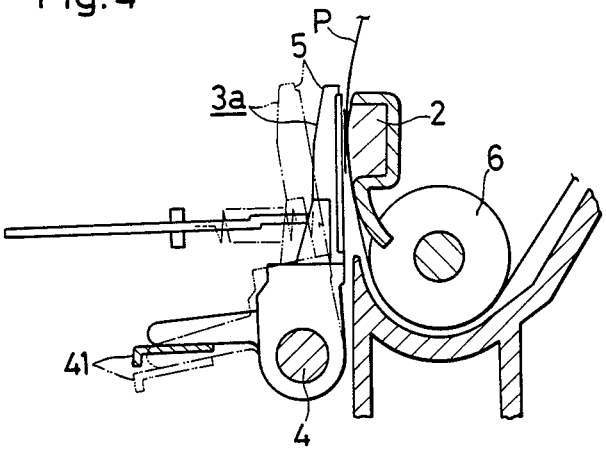
Figure 5:
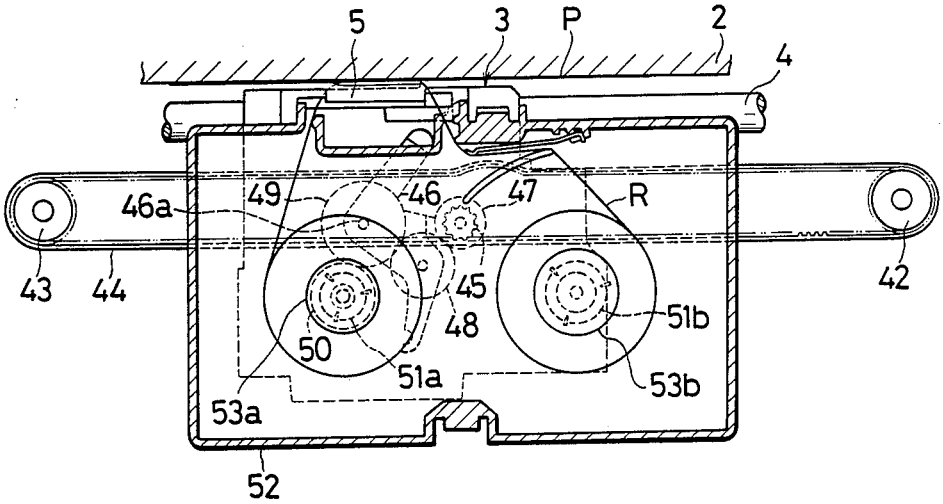
Figure 6:
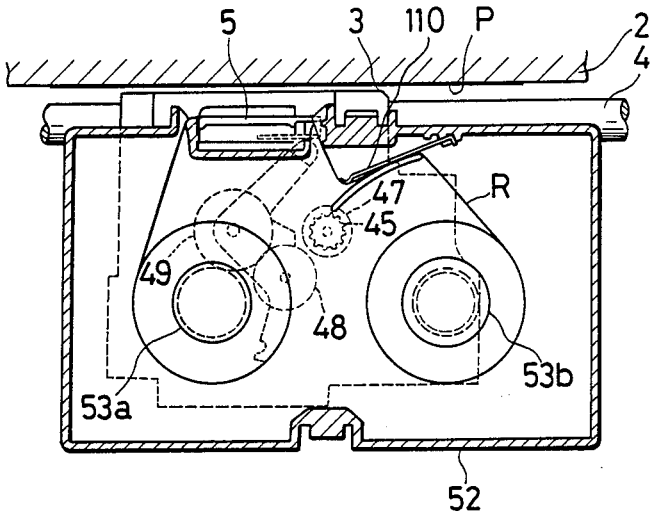

Next, brief description is made on a carriage feed mechanism and a ribbon feed mechanism based on FIG. 4 through FIG. 6.

The carriage 3 is supported slidably on the guide rod 4. A head carriage part 3*a* is hanged over to the print position illustrated by a full line in FIG. 4 and to the non-printing position illustrated by a phantom line by a release lever 41 which is position-switched up and down.

As shown in FIG. 5, driving pulleys 42 and idling pulleys 43 which are driven by a carriage driving motor are disposed respectively at the right end part and the left end part in the main unit case 1. A timing belt 44 is set around the both pulleys 42 and 43, and the timing belt 44 penetrate through the carriage 3, extending in two parallel sides. Part of the rear-side of timing belt 44 is fixed to the carriage 3. The front-side of timing belt 44 is engaged with a driving gear 45. When the thermal head 5 is located at the print position, as shown in FIG. 5, a swing lever 46 rotates counterclockwise around a supporting shaft 46*a*, and a first gear 47 installed above the driving gear 45 engages with a second gear 48 installed above the swing lever 46. Also, when the thermal head 5 is located at the non-print position, as shown in FIG. 6, the swing lever 46 rotates clockwise around the supporting shaft 46*a*, and the second gear 48 disengages from the first gear 47.

A third gear 49 which rotates around the supporting shaft 46*a* and engages with the second gear 48 are installed on the swing lever 46. A fourth gear 50 engaging with the third gear 49 is installed in the carriage 3. A connecting cylinder 51*a* for take-up is installed above the fourth gear 50. A connecting cylinder 51*b* for feed is installed on the right of the connecting cylinder 51*a*. A ribbon cassette 52 is loaded on the carriage 3, and a take-up spool 53*a* and a feed spool 53*b* thereof are fitted to the connecting cylinder 51*a* and the connecting cylinder 51*b*, respectively. A thermo-transfer ribbon R extends from the feed spool 53*b* and passes through the head surface of the thermal head 5, being taken-up on the take-up spool 53*a*. When the thermal head 5 is set up at the print position and printing is performed on the print paper P while moving the carriage 3 rightward by rotating the driving pulley 42 clockwise, the connecting cylinder 51*a*, that is, the take-up spool 53*a* is driven to rotate counter-clockwise by the driving gear 45 through the first gear 47, the second gear 48, the third gear 49 and the fourth gear 50. Thereby the ribbon R is taken-up on the take-up spool 53*a* from the feed spool 53*b* (refer to FIG. 5). On the other hand, when the thermal head 5 is swing-moved to the non-print position and the carriage 3 is moved leftward by rotating the driving pulley 42 counterclockwise, the first gear 47 disengages with the second gear 48. Accordingly, the connecting cylinder 51*a*, that is, the take-up spool 53*a* is not driven to rotate, and the ribbon R is pulled back in the ribbon cassette 52 by a plate spring 110.

Here, the thermo-transfer ribbon R can be used not only as a printing ribbon but also as a correcting ribbon, being constituted as follows.

Figure 7:
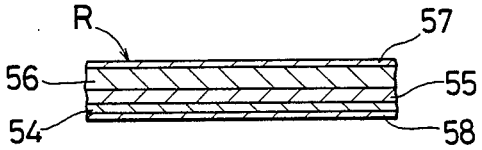

As shown in FIG. 7, the thermo-transfer ribbon R is such that a peel-off layer 55 is formed on a supporter 54 made of polyester film, and ink layer 56 is formed thereon, and a top coat layer 57 is formed on the top surface thereof. Also, a sticking preventing layer 58 composed of a heat resisting resin such as silicone resin is installed on the surface opposite to the coated surface of the ink layer 56.

The ink layer 56 is constituted with a colorant and a binding agent, and a pigment such as carbon black is used for the colorant. The binding agent has a melting viscosity of about $10^2$–$10^5$CP(centipoise) at a temperature of about 150° C., and the main component thereof is a kind of thermo-plastic resin such as polyamido or polyester which does not melt together with a constitutive component of the top coat layer 57 as described later. This purpose is to raise the melting viscosity and also to increase the agglomerating force of the thermo-melting ink itself at the transferring stage. Also, the peel-off layer 55 is constituted with polyethylene wax and ester wax which have poor adhesive forces to the film-shaped supporter 54 at a suitable melting point (80°–120° C.). The top coat layer 57 has a high melting viscosity, and the main component thereof is ethylene acetic and vinyl copolymer resin whose adhesive force to the print paper P is comparatively weak. In order to prevent permeation into the print paper P and improve the peel-off property when erasing the misprinted character without reducing the transferring ability so much, a viscosity increasing agent such as metallic soap, airosil or bentonite and one, two or more kinds of gelatinizers may be mixed.

Figure 8:
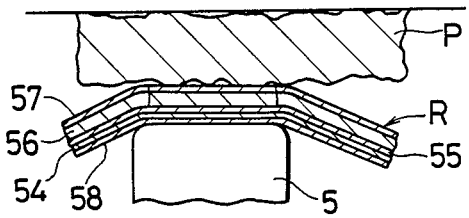
Figure 9:
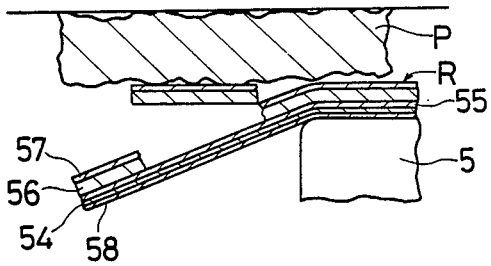

Here, based on FIG. 8 and FIG. 9, description is made on transfer of the thermomelting ink onto the print paper P in the case where characters are printed on the print paper P having a low smoothness using the thermo-transfer ribbon R.

The thermo-transfer ribbon R is brought in press-contact with the print paper P on the platen 2 by the thermal head 5, and when the thermal head 5 is heated, heat is conducted to the peel-off layer 55 and the ink layer 56 through the sticking preventing layer 58 and the supporter 54, being transferred onto the top coat layer 57. Then, the peel-off layer 55, the ink layer 56 and the top coat layer 57 are melted, and the top coat layer 57 in contact with the convex part of the print paper P adheres to (partly permeates into) that convex part together with the ink layer 56. Then, when the heating of the thermal head 5 ends, the top coat layer 57 and the ink layer 56 are cooled, being fixed to the print paper P. At this time, the heated portion of the peel-off layer 55 still holds the melted state. The ink layer 56 corresponding to this character portion has a strong agglomerating force inside, while it has a very weak adhesive force to the peel-off layer 55 (remarkably small in comparison with the adhesive force between the ink layer and the peel-off layer at the non-heated portion). Accordingly, when the thermo-transfer ribbon R is peeled off, the adhesive force between the print paper P and the top coat layer 57 or between the top coat layer 57 and the ink layer 56 is larger than the adhesive force between the supporter 54 and the peel-off layer 55 or between the peel-off layer 55 and the ink layer 56, and the agglomerating force of the top coat layer 57 itself is also large. Consequently, the ink layer 56 of the heated portion, that is, the portion of printed characters is pulled off to the top coat layer 57 side as shown in FIG. 9. Thereby, transferring onto the print paper P can be made easily including the portion not in contact with the print paper P (concave part).

Figure 10:
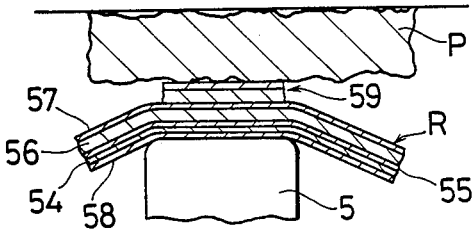
Figure 11:
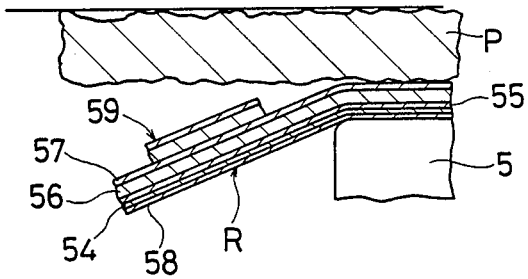

Next, description is made on the case where erasure of the misprinted characters is performed by the thermo-transfer ribbon R based on FIG. 10 and FIG. 11.

The thermo-transfer ribbon R is brought in press-contact with an ink 59 of the misprinted characters on the print paper P placed on the platen 2 by the thermal head 5. When the thermal head 5 is heated in this state, heat is conducted to the peel-off layer 55, the ink layer 56, the top coat layer 57 and the ink 59 of the misprinted character through the sticking preventing layer 58 and the supporter 54, and these four are melted. Then, when energizing of the thermal head 5 is stopped, the four are cooled. After a predetermined short lapse of time, the ink 59 of the misprinted characters and the top coat layer 57 harden in the state of adhering to each other. At this time, the adhesive force between the print paper P and the ink 59 of the misprinted character is small in comparison with the adhesive forces between the supporter 54 and the peel-off layer 55, between the peel-off layer 55 and the ink layer 56, between the ink layer 56 and the top coat layer 57, and between the top coat layer 57 and the ink 59 of the misprinted character. When the thermo-transfer ribbon R is pulled in the direction of separation from the print paper P in this state as shown in FIG. 10, the ink 59 of the misprinted character on the print paper P is peeled off the print paper P. Thereby, the ink 59 is transferred to the thermo-transfer ribbon R side, and the misprinted character is erased.

Figure 12:
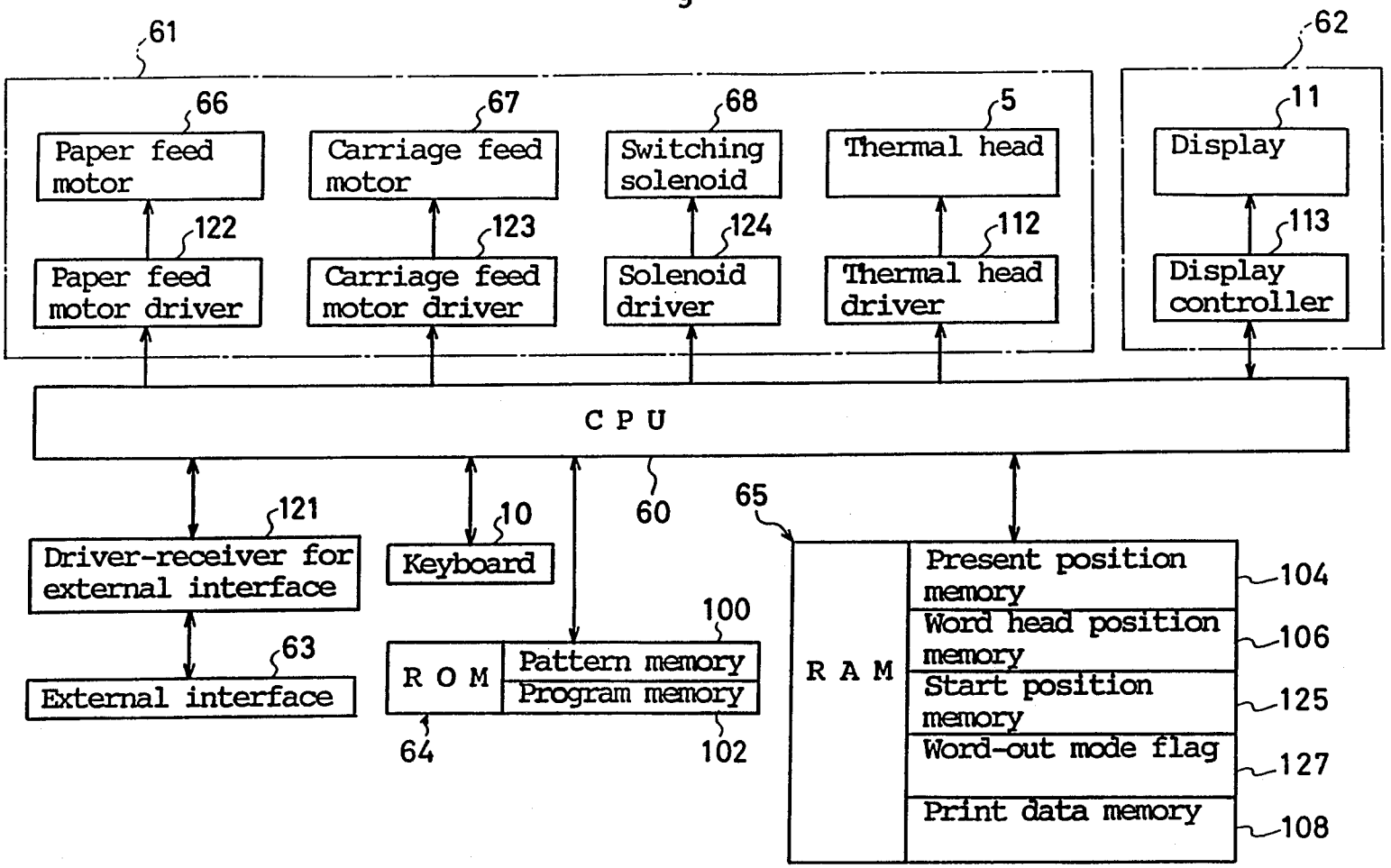

Next, description is made on a controlling apparatus of the electronic typewriter thus constituted in reference to a block diagram in FIG. 12.

To a CPU (central processing unit) 60, a printing mechanism 61, a displaying mechanism 62, a driver-receiver 121 for external interface connected to an external interface 63, the keyboard 10, a ROM (read only memory) 64, and a RAM (random access memory) 65 are connected as illustrated in the figure.

The above-mentioned printing mechanism 61 provides a paper feed motor 66 and a paper feed motor driver 122 which drive a paper feed roller, a carriage feed motor 67 and a carriage feed motor driver 123, a switching solenoid 68 and a solenoid driver 124, which selectively switch the thermal head 5 between the print position and the non-print position, the thermal head 5 and, a thermal head driver 112.

The displaying mechanism 62 is constituted with the display (liquid crystal display) 11 and a display controller 113.

Also, the ROM 64 provides a pattern memory 100 storing pattern data such as characters and symbols and a program memory 102 storing control programs controlling the printing mechanism 61 and the displaying mechanism 62, a control program for erasing characters as described later, a program for suspending character erasure.

In the RAM 65, a present position memory (print position pointer) 104 storing at least the present position of the thermal head 5 corresponding to the print position, a word head position memory 106 storing the print position of the head character of a word, a start position memory 125 storing the position of the thermal head 5 when erasing operation is started, a word-out mode flag 127 which is set and whereto a 1 is written in the word-out mode, a print data memory 108 storing the inputted code data corresponding to the print position, various temporary memories required for controlling the printing mechanism 61 and the displaying mechanism 62 and the like are installed.

The CPU 60 makes the print data memory 108 of the RAM 65 store sequentially the code data corresponding to characters and symbols such as alphabet, numerals and space which are entered through the keyboard 10. Also, it reads sequentially the pattern data corresponding to these code data from the pattern memory 100 of the ROM 64, and outputs them to the display controller 113, a thermal head driver 112 and the carriage feed motor driver 123. Furthermore, it outputs control signals corresponding to the code data entered from various function keys to the paper feed motor driver 122, the carriage feed motor driver 123, the solenoid driver 124 and the display controller 113.

Next, description is made on outlines of word erase control and word erase suspend control.

Figure 13:
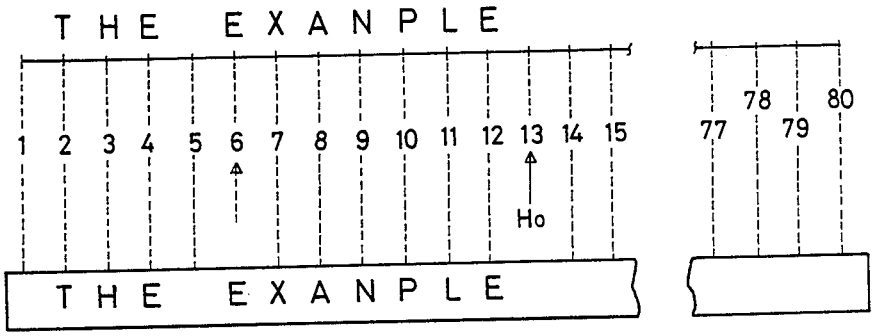

FIG. 13 illustrates a character string which has been printed with wrong spelling "THE EXANPLE" and the data in the print data memory as one example.

When the above-mentioned misprinted word "EXANPLE" is erased, an erase command is outputted to the CPU 60 by operating the word-out key 40 in the state that the thermal head 5 is located at the position of $H_0$ of the thirteenth digit or the print position of any of the sixth digit through the twelfth digit.

Based on the erase control program, the CPU 60 detects the print position of the head character of "EXANPLE" (the print position of the sixth digit in the figure) using the data from the present position memory 104 and the print data memory 108 of the RAM 65. Then the thermal head 5 is moved to this head character position, and then "EXANPLE" is printed on "EXANPLE" in a superposed fashion, and thereby this misprinted word is erased in a sequential fashion. At the same time, every time each printed character of the above-mentioned "EXANPLE" is erased, the data in the print data memory 108 corresponding to each erased character is erased.

Then, after erasure of the above-mentioned misprinted word "EXANPLE", the thermal head 5 is moved again to the head character position of the misprinted word, and the word can be reprinted with the corrected spelling.

On the other hand, in the case where the operator commands a word erasure by operating the word-out key 40, but becomes aware of this wrong designation of the word to be erased, and operates the word-out suspend key 126, the word erasure is suspended. In this case, when the word-out suspend key 126 is operated while the thermal head 5 is moving to the head position of the word detected for erasing characters, the thermal head 5 moves to the original position before starting the movement. Also, when the word-out suspend key 126 is operated while the thermal head 5 is executing character erase from the head position of the word, the thermal head 5 moves to the head position of the word, that is, the position of the sixth digit.

Thus, when a character erase is not started, the thermal head 5 moves to the original print position before starting the movement, and therefore the printing can be continued from that print position. Also, when the character erase is started, the thermal head 5 moves to the head position of the word, and therefore the characters can be printed again.

Next, description is made on two examples relating to word erase control and word erase suspend control performed in the controlling apparatus of the above-mentioned electronic typewriter in reference to flowcharts.

A first example relating to word erase control

Figure 14A:
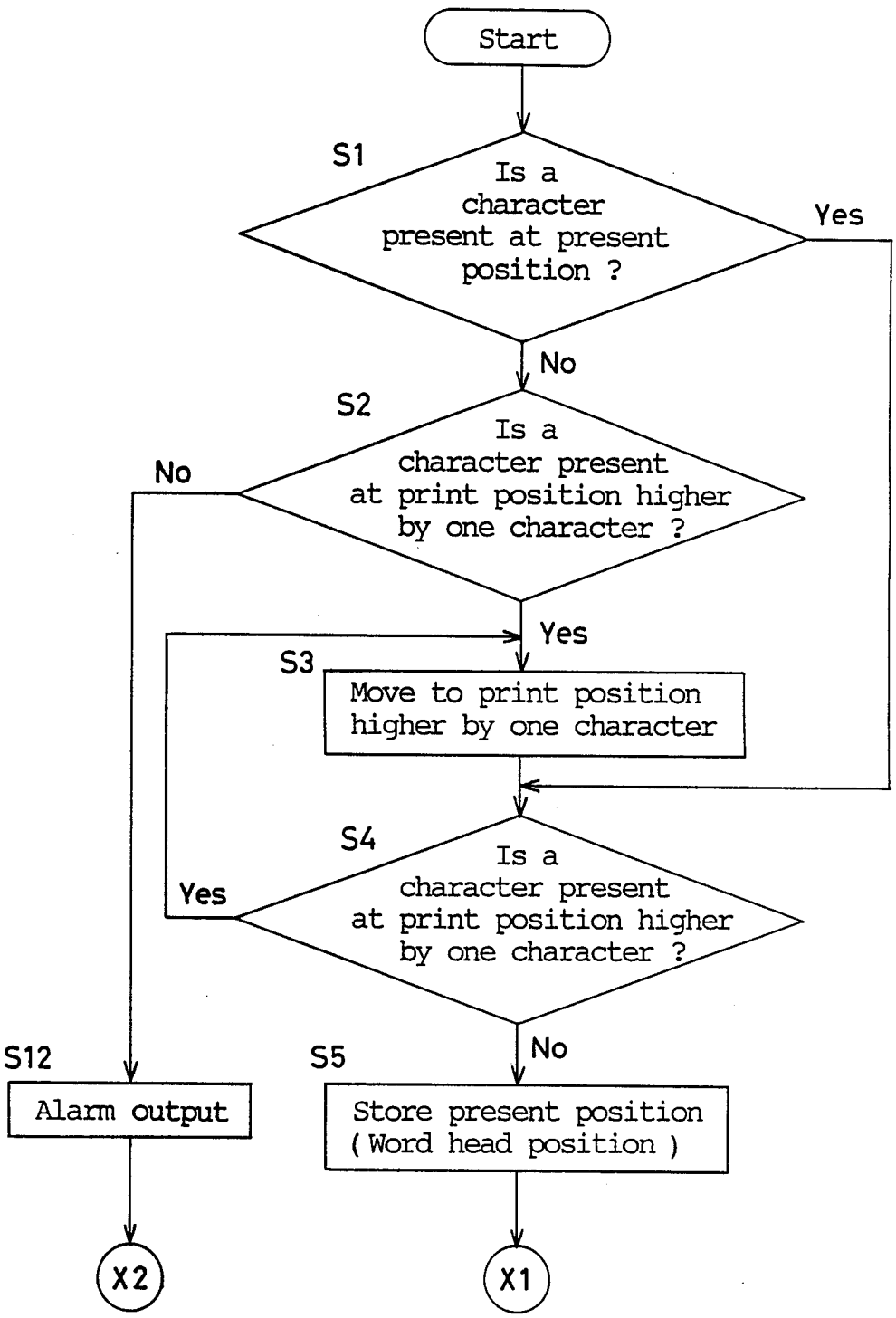
Figure 14:
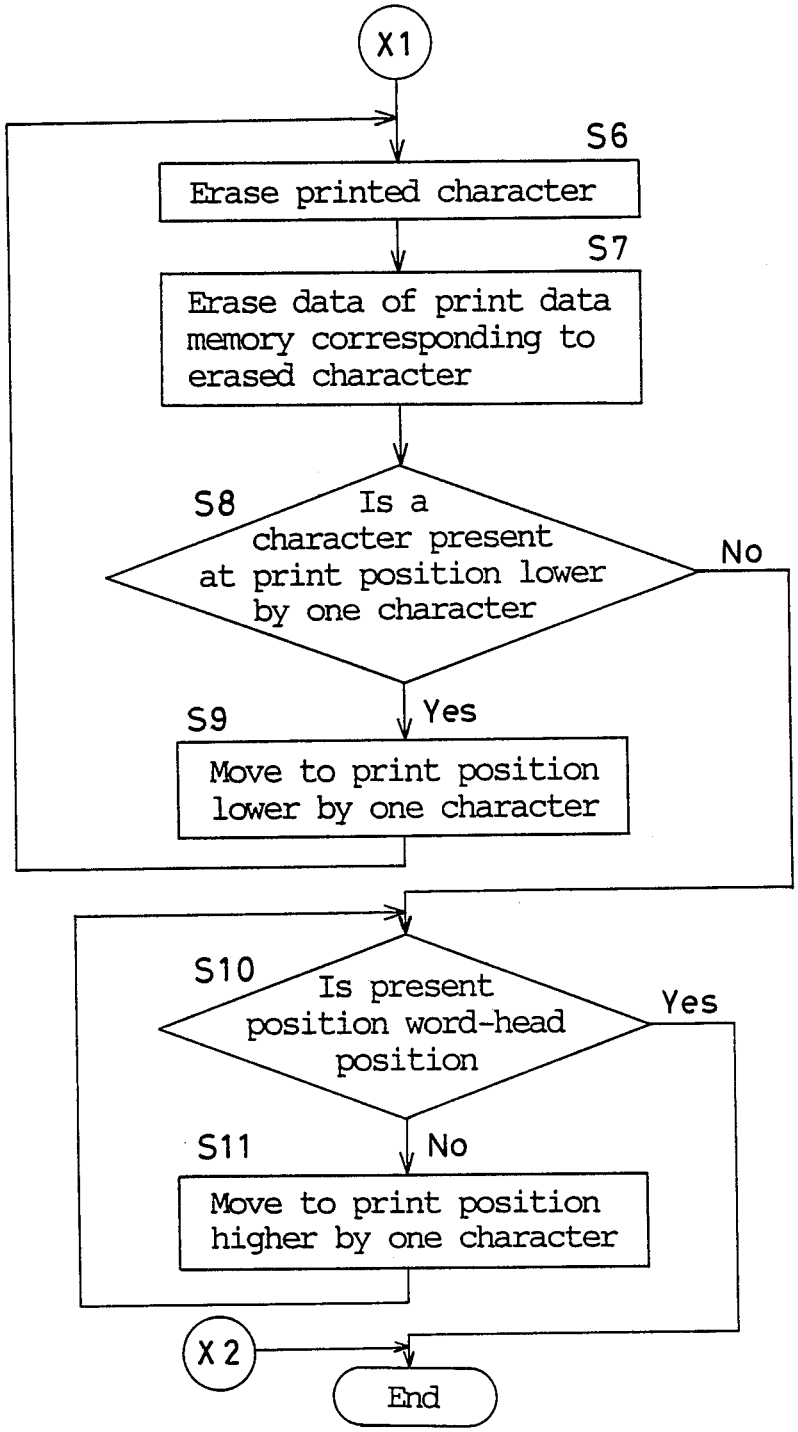

First, description is made on a first example of a flowchart of control routine of automatic word erase control in reference to FIG. 14.

When an erase signal is outputted to the CPU 60 by depressing the word-out key 40, this control is started, and processing moves to step S1 (hereinafter represented simply as S1, the same is true of the other steps). In S1, decision is made on whether or not a character is present at the present position of the thermal head 5 (whether printed or not), based on the data of the present position memory 104 and the data of the print data memory 108. When a character is present at the present position, processing shifts to S4, and when no character is present, processing returns to S2.

In S2, decision is made on whether or not a character is present at the print position higher by one character (in the direction reverse to the printing direction), and when a character is present, processing shifts to S3, and when no character is present, processing shifts to S12. For example, the case where no character is present at the present position and the print position higher by one character refers to the case where the thermal head 5 is located at the print position of the fourteenth digit in FIG. 13 or the case where the thermal head 5 corresponds to the space of the first digit and the higher-order side therefrom is left margin. In these cases, in S12, alarm is indicated by a buzzer or an alarm lamp, and thereafter the control ends. As a result of the decision in S2, if a character is present at the print position higher by one character, processing shifts to S3, and the thermal head 5 moves to the print position higher by one character (this position is equivalent to the print position of the last character of the word).

Next, in S4, decision is made again on whether or not a character is present at the print position higher by one character from that print position. When a character is present, that is, in the case of the character string consisting of plural characters, processing returns to S3, and by repeating S3 and S4, the thermal head 5 is moved sequentially to the higher-order side. Then, when the thermal head 5 reaches the print position of the head character of the word, processing shifts to S5. In this case, when one word covers two print lines, the paper feed roller 6 is rotated by an angle equivalent to one line in the direction of paper return, and the print paper P is rolled back by a length of one line. Also in the case of the word consisting of one character, or in the case where the present position is the word head position, processing immediately shifts to S5.

In S5, the present position of the thermal head 5, that is, the head position of the word is stored in the word head position memory 106. Subsequently, in S6, the same characters are printed in a superposed fashion on the printed characters located at the print position corresponding to the present thermal head 5, and thereby the printed characters are erased. In this case, the CPU 60 outputs control signals to a thermal head driver 5*a* and the carriage feed motor driver 123 of the printing mechanism 61 based on the data of the present position memory 104 and the data of the print data memory 108 corresponding to this present position. Furthermore, in S7, the data of the print data memory 108 corresponding to the characters erased in S6 are erased.

Next, in S8, decision is made on whether or not a character is present at the print position lower by one character from the present position of the thermal head 5, and when a character is present, processing shifts to S9, and when no character is present, processing shifts to S10. In S9, the thermal head 5 is moved to the position of the next printed character, that is, to the print position lower by one character. Furthermore, processing shifts from S9 to S6, and S6 and the following steps are repeated, and the printed characters following the head character of the word are erased in sequence. Then, when the word is erased to the last character, in S8, it is decided that no character is present at the print position lower by one character, and processing shifts from S8 to S10.

The following S10 and S11 are steps for moving the thermal head 5 to the head character position of the word erased as mentioned above. In S10, decision is made on whether or not the present position of the thermal head 5 is the word head position using the data of the present position memory 104 and the data of the word head position memory 106. As a result of the above-mentioned decision, if not the head position, processing shifts to S11, and in S11, the thermal head 5 is moved to the print position higher by one character. Furthermore, processing shifts from S11 to S10, and S10 and S11 are repeated. When the thermal head 5 reaches the word head position, in S10, it is decided that the present position is the word head position, and the word erase control ends.

Furthermore, such a configuration can be considered also that in place of the thermo-transfer ribbon R of this embodiment, a ribbon wherein one half-width portion is a thermo-transfer ribbon for printing and the other half-width portion is a correcting ribbon for erase is used, and the thermo-transfer ribbon and the correcting ribbon are automatically changed over up and down by a solenoid or the like. Also, it is possible that in the case where the thermosensitive paper is used for the print paper P, a correcting ribbon having a structure of thermo-transfer in white is loaded in a ribbon cassette, and the ribbon cassette is swung up and down, and thereby the correcting ribbon is positioned on the head surface of the thermal head 5 only when a character is erased.

In the above-mentioned embodiment, description is made on the case where a predetermined length of character string is a word, but one print line comprising plural words may be taken as a predetermined length of character string. In this case, for example, a line erase command key is installed on the keyboard 10, and when this key is operated, erase is performed on a one print line basis. On the other hand, erasure on a one character basis can be also considered as the shortest of a predetermined length of character string.

Figure 15A:
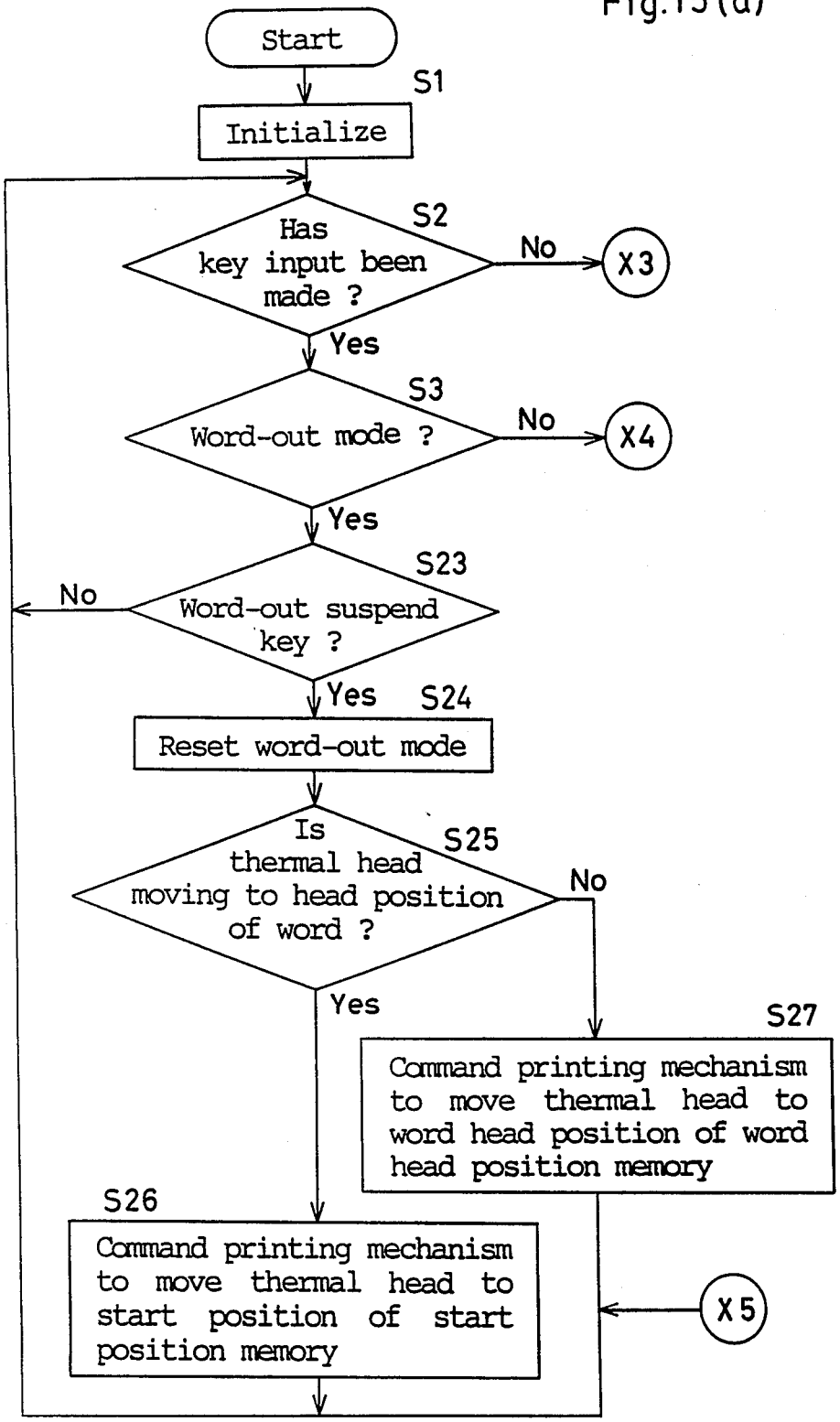
Figure 15B:
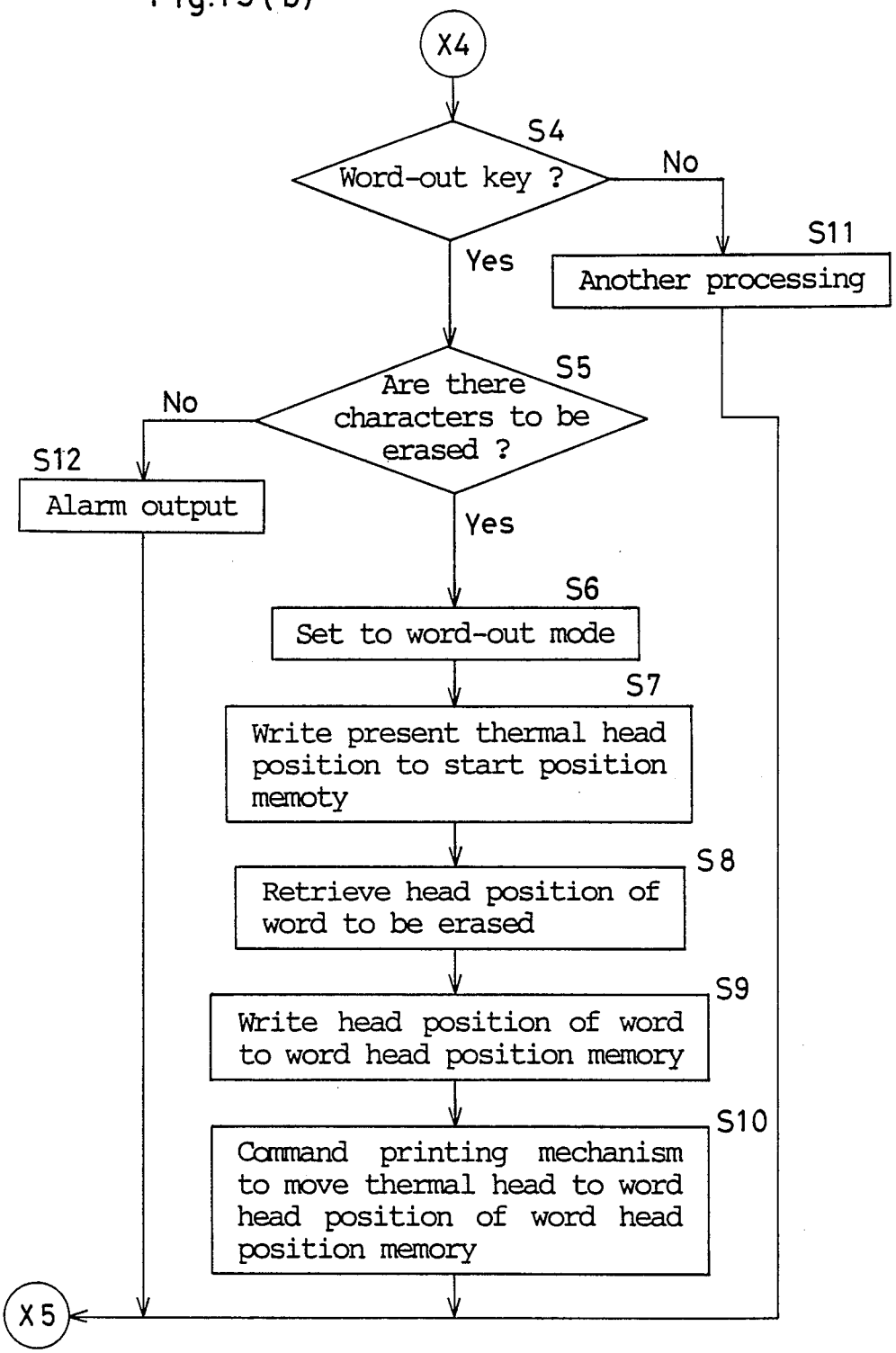
Figure 15:
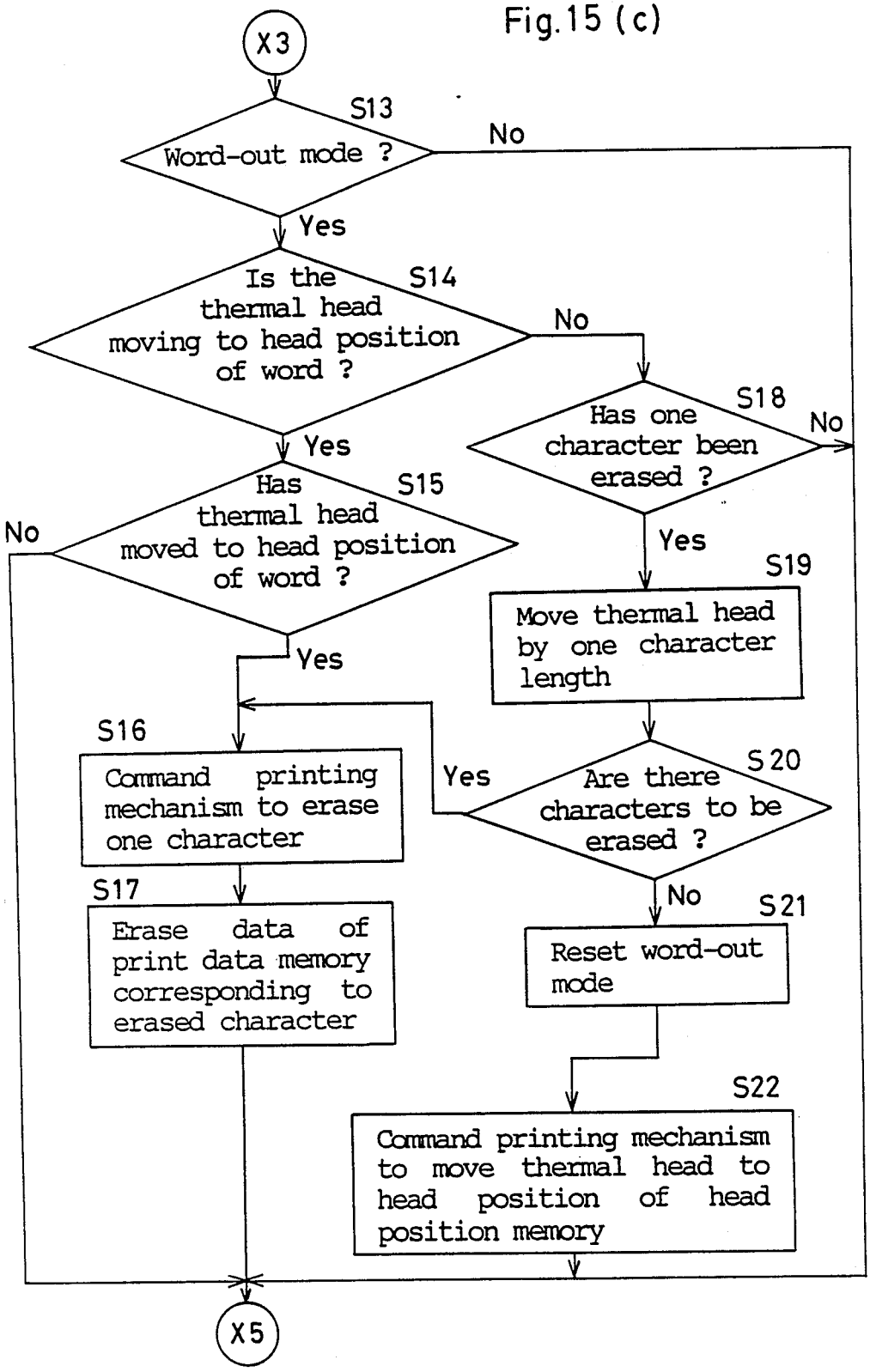

A second example relating to word erase control and word erase suspend control Next description is made on a second example of the flowchart of the control routine which performs word erase suspend control in addition to automatic word erase control in reference to FIG. 15.

When the power switch of the electronic typewriter is turned on, this control is started, and in step S1 (hereinafter represented simply as S1, and the same is true of the other steps), initialization is performed, and execution of S2 follows. In S2, decision is made on whether or not a key-input has been made (whether or not a key has been operated). When a key has been operated, processing shifts to S3, and when no key has been operated, processing shifts to S13.

In S13, decision is made on whether or not the word-out mode, that is, the erase mode is set (whether or not a 1 is set in the word-out mode flag 127). If the word-out mode is set, processing shifts to S14, and if the word-out mode is not set, processing returns to S2.

Also, in S3, decision is made on whether or not the word-out mode is set based on the word-out mode flag 127. If the word-out mode is set, processing shifts to S23, and if the word-out mode is not set, processing shifts to S4. In S4, decision is made on whether or not the key operated in S2 is the word-out key 40. If YES, processing shifts to S5, and if NO, another processing in S11 is performed.

For example, in S11, when a character key, a symbol key or the like is operated, the code data thereof is stored in the print data memory 108 of the RAM 65, and the processings such as character printing and character displaying corresponding to that code data are performed.

In S5, based on the data of the present position memory 104 and the data of the print data memory 108, decision is made on whether or not the character to be erased is present at the present position of the thermal head 5 or at the print position higher by one character therefrom (in the direction reverse to the printing direction). When the character to be erased is present (when the thermal head 5 is located at the position of the sixth digit through the thirteenth digit in FIG. 13), processing shifts to S6. Also, when no character to be erased is present, alarm processing in S12 (a buzzer and a lamp) is executed, and thereafter processing returns to S2.

In S6, a 1 is written to the word-out mode flag 127 of the RAM 65 and the word-out mode is set. In the following S7, based on the data of the present position memory 104, the present print position of the thermal head 5 is written to the start position memory 125. In S8, based on the data of the print data memory 108, the head position of the word to be erased (position of the sixth digit in FIG. 13) is retrieved. In S9, the head position of the word retrieved in S8 is written to the word head position memory 106.

Next, in S10, based on the data of the word head position memory 106 and the data of the present position memory 104, the printing mechanism 61 is commanded to move the thermal head 5 to the word head position, and processing returns to S2.

In this stage, the word-out mode is set, and therefore when the control moves from S2 to S13, the result of the decision in S13 becomes YES, and processing shifts to S14. In S14, based on the data of the present position memory 104 and the data of the word head position memory 106, decision is made on whether or not the thermal head 5 is now moving to the head position of the word. If the thermal head 5 is moving, processing shifts to S15, and if it is not moving, processing shifts to S18.

In S15, decision is made on whether or not the thermal head 5 has moved to the head position of the word. If the movement is not completed, processing returns to S2, Also, when the movement has ended, S16 is executed, and the CPU 60 commands the printing mechanism 61 to erase the printed character at the position facing the thermal head 5. Then, in S17, the data of the print data memory 108 corresponding to the character erased in S16 is erased, and processing returns to S2.

Thus, when the character erasure is started, processing shifts to S18 through S2, S13 and S14. In S18, decision is made on whether or not one character has been erased by the printing mechanism 61, and if the erase is not completed, processing returns to S2. Then, S2, S13, S14 and S18 are repeated on a minute time basis until the erase of one character is completed. When the erase of one character is completed, the result of the decision in S18 becomes YES, and processing shifts to S19. In S19, the CPU 60 commands the printing mechanism 61 to move the thermal head 5 to the print position lower by one character (in the printing direction). In the following S20, based on the data of the present position memory 104 and the data of the print data memory 108, decision is made on whether or not the printed character is present at the present position, and if the printed character is present, processing shifts to S16. If no printed character is present (for example, when the thermal head 5 is located at the position of the last character of the word at the 12th digit), processing shifts to S21. This means that in the case of a word consisting of plural characters, S2, S13, S14, S18, S19, S20, S16, S17 are repeated and when the thermal head 5 erases to the last character of the word, processing shifts to S21. In S21, a 0 is written to the word-out mode flag 127 of the RAM 65, and thereby the word-out mode is reset. Then, in the following S22, based on the present position memory 104 and the word head position memory 106, the CPU 60 commands the printing mechanism 61 to move the thermal head 5 to the head position of the word, and processing returns to S2.

On the other hand, when the result of the decision in S3 is YES, that is, when the word-out mode, processing shifts to S23, and the decision is made on whether or not the key operated in S2 is the word-out suspend key 126. If YES, processing shifts to S24, and if NO, processing returns to S2. In S24, a 0 is written to the word-out mode flag 127, and the word-out mode is reset. Subsequently, in S25, decision is made on whether or not the thermal head 5 is moving to the head position of the word, and when it is moving, S26 is executed. In S26, character erase is not executed yet, and therefore based on the data of the present position memory 104 and the data of the start position memory 125, the CPU 60 commands the printing mechanism 61 to move the thermal head 5 to the start position, and processing returns to S2. Also, when the result of the decision in S25 is NO, that is, when character erase is being executing, processing shifts to S27. In S27, based on the data of the present position memory 104 and the data of the word head position memory 106, the CPU 60 commands the printing mechanism 61 to move the thermal head 5 to the head position of the word, and processing returns to S2. In addition, if the character erasing operation is being performed at this time, one character is erased, and thereafter the thermal head 5 is moved to the head position of the word.

As described above, in this embodiment, word-out (word erase) can be suspended even after the command of word-out, and when the word-out is suspended, the thermal head 5 can be moved to the start position where to the thermal head 5 is to be returned or to the head position of the word. For this reason, the damage when commanding word-out by misoperation can be suppressed to a minimum.

In addition, in place of the control in S19 of this embodiment, such a configuration may be applied that after character erasure, only when the printed character is present at the print position lower by one character from the thermal head 5, the thermal head 5 moves to that print position and erases the character.

Also, the present invention is applicable to a printing apparatus which loads a single type such as a typewheel on the carriage and takes up the correcting ribbon in interlocking with the movement of the carriage.

In the case of the above-mentioned printer of impact system employing the type-wheel, the conventional apparatuses require erase operation for every backspace of one character, but in accordance with the present invention, only one-time erasure suffices.

The present invention is effective particularly for a printing apparatus providing a printing mechanism which has a character generator storing a number of font patterns of characters and prints characters of dot-matrix shape on the print paper by those font patterns.

For example, also in the case of the printing mechanism of wire-dot system, character-erase operation is executed in the same sequence as in printing, and therefore erase operation in the direction reverse to the printing direction as in the case with the conventional apparatuses requires readout in the direction from the front string to the rear string, greatly complicating the control.

What is claimed is:

1. A character erasable printing apparatus comprising:

inputting means for inputting data, print data memory means for storing data inputted from said inputting means corresponding to a desired print position;

printing means having a thermal printing head for printing characters in character strings beginning with a head character and ending with a last character corresponding to data inputted from said inputting means on a print paper, while moving rightward;

present position memory means for storing data of the present position of the printing head corresponding to its print position;

erasing means for erasing a character string printed by said printing means in response to an erase command from said inputting means sequentially from the head character to the last character while moving rightward;

a single thermo-transfer ribbon capable of printing and erasing using a common area of said ribbon for said printing means and said erasing means;

ribbon driving means for playing out said thermo-transfer ribbon only when the thermal printing head moves rightward during printing and erasing; and erase controlling means for, on the basis of the data in said print data memory means and the data in said present position memory means upon receiving an erase command from said inputting means, initially outputting, to said printing means a control signal for moving said printing head to the print position of the head character of the character string indicated by the present position of said printing head and subsequently outputting an erase control signal for erasing printed characters of the character string sequentially from the head character to the last character to the erasing means, and for controlling the printing means to move the printing head to the position of the head character of the erased character string after erasing of said character string.

2. A character erasable printing apparatus according to claim 1, wherein:

said printing means includes a character generator, and said printing means prints dot-matrix characters according to font patterns stored in said character generator.

3. A character erasable printing apparatus according to claim 1, wherein said erase controlling means includes erase suspend controlling means for suspending erasing operation of the erasing means in response to an erase suspend command signal from said inputting means.

4. A character erasable printing apparatus according to claim 3, wherein said erase suspend controlling means further outputs to the printing means a control signal which moves the printing head to the initial position before inputting an erase command when said printing head is moving to the head character side of said character string and moves the printing head to the print position of the head character when the printing head is moving to the last character side while erasing characters.

5. A character erasable printing apparatus according to claim 1, wherein said thermo-transfer ribbon includes at least a top coat layer, an ink layer behind the top coat and a peel-off layer behind the ink layer, and said top coat layer carries the ink layer, adheres on the print paper when printing and peels off the ink layer, carrying the top coat layer when erasing.

6. A character erasable printing apparatus according to claim 5, wherein said erase controlling means controls said erasing means to erase each of said printing characters by thermo-transferring the same character through said thermo-transfer ribbon.

* * * * *